US007988517B2

(12) United States Patent
Bishop

(10) Patent No.: US 7,988,517 B2
(45) Date of Patent: Aug. 2, 2011

(54) CONSTRUCTION AND GAMING CUBES

(76) Inventor: Forrest Frederick Bishop, Seattle, WA (US)

( * ) Notice: Subject to any disclaimer, the term of this patent is extended or adjusted under 35 U.S.C. 154(b) by 638 days.

(21) Appl. No.: 12/012,409

(22) Filed: Feb. 1, 2008

(65) Prior Publication Data

US 2008/0280523 A1 Nov. 13, 2008

Related U.S. Application Data

(63) Continuation-in-part of application No. 11/801,904, filed on May 11, 2007.

(51) Int. Cl.
*A63H 33/04* (2006.01)
*A63H 33/08* (2006.01)

(52) U.S. Cl. ..... 446/85; 446/108; 446/124; 446/127

(58) Field of Classification Search ..... 446/85, 446/108, 114, 115, 120, 121, 124, 125, 127; 273/153 R, 156, 157 R
See application file for complete search history.

(56) References Cited

U.S. PATENT DOCUMENTS

| | | | | | |
|---|---|---|---|---|---|
| 2,020,562 | A | * | 11/1935 | Miller | 446/127 |
| 3,327,882 | A | * | 6/1967 | Andrews | 220/4.28 |
| 3,410,474 | A | * | 11/1968 | Keil | 206/586 |
| 3,552,817 | A | * | 1/1971 | Marcolongo | 312/107 |
| 3,690,672 | A | * | 9/1972 | Dreyer | 273/155 |
| 3,722,971 | A | * | 3/1973 | Zeischegg | 312/107 |
| 3,974,934 | A | * | 8/1976 | Rohner | 220/4.28 |
| 4,160,337 | A | * | 7/1979 | Fischer | 446/127 |
| 4,345,762 | A | * | 8/1982 | Lebelson | 273/157 R |
| 5,086,999 | A | * | 2/1992 | Mullen | 244/159.4 |
| 5,267,863 | A | * | 12/1993 | Simmons, Jr. | 434/96 |
| 5,549,198 | A | * | 8/1996 | Thiele et al. | 206/307 |
| 5,664,387 | A | * | 9/1997 | Bhatti | 52/604 |
| 5,775,046 | A | * | 7/1998 | Fanger et al. | 52/590.1 |
| 5,826,873 | A | * | 10/1998 | Lavermicocca | 273/157 R |
| 6,386,936 | B1 | * | 5/2002 | Gebara | 446/117 |
| 6,497,018 | B1 | * | 12/2002 | Chiu et al. | 27/2 |
| D506,790 | S | * | 6/2005 | Gee | D21/479 |
| 2004/0102132 | A1 | * | 5/2004 | Miller et al. | 446/125 |

* cited by examiner

*Primary Examiner* — Gene Kim
*Assistant Examiner* — Alyssa M Hylinski
(74) *Attorney, Agent, or Firm* — Mark S. Hubert

(57) ABSTRACT

This invention generally relates to a set of parallelepipedal bodies (cubes) capable of matingly compatible engagement for interconnection with substantially similar cubes or matingly conformed rails, so as to allow up to three degrees of freedom in the sliding movement of an individual cube or grouping of cubes about a grouping of other interconnected cells from the set. Each cube is constructed from six plates with an interior physical configuration adapted for connection and that lends itself to monolithic injection molding. The exterior physical configuration of all plates are substantially similar. When a number of cubes are assembled into a cubic array, there can be slab movement, row movement or solo cube movement.

6 Claims, 14 Drawing Sheets

CONSTRUCTION AND GAMING CUBES

This application is a continuation-in-part of application claiming benefit under 35 U.S.C. §121 U.S. non-provisional application Ser. No. 11/801,904 filed May 11, 2007. The benefit of which is claimed, is considered to be a part of the disclosure of the accompanying application and is hereby incorporated herein its entirety by reference.

TECHNICAL FIELD

This invention generally relates to a set of cubes, or generally parallelepipedal bodies and matingly conformed rails, capable of sliding engagement so as to allow variable single cube movement and placements within an array of substantially similar cubes and or rails. These cubes form excellent building blocks for hand puzzles and structural construction sets as well as lending themselves to adaptation for a plethora of other uses including slidingly engagable housings for electromagnetic motor drives.

BACKGROUND OF THE INVENTION

The present invention relates to a set of unique parallelepipedal cubes, capable of a hollow core construction. Each cube has six plates, the internal faces of which may matingly interlock in a synergistic design for assembly. In its simplest form, there is only one plate used in the assembly of each cube. This plate can be injection molded in one piece. In another embodiment only two different plates are required to form a cube. The exterior faces of the two plates are substantially similar in physical configuration and are rectangular, however the interior faces differ in the arrangement and number of linear members and slots used for the assembly of the cube.

The exterior face design is such that all exterior faces matingly interlock for sliding engagement. In this manner the cubes are free to move about each other individually or in groupings, generally with three degrees of freedom, i.e., movement is allowed in each of the X, Y and Z axis.

The interlocking design on the interior face of each face plate maximizes the amount of hollow interior space while providing for a rigid unibody design wherein the strength of the cell is a synergistic function of all six face plates. The ease of fabrication and plethora of applicable uses are some of this invention's stronger features.

When a multitude of cubes are assembled into an array, preferably cubic, there can be slab movement, row movement, or solo cube movement.

This invention's design overcomes the drawbacks of the prior art in that it greatly simplifies the mass fabrication of the cubes as well as the ease of arranging cube groupings about another cube or cube grouping.

SUMMARY OF THE INVENTION

In accordance with the invention, an object of the present invention is to provide an improved, enclosed hollow body cube, constructed with a minimum of generally planar plates.

It is another object of this invention to provide a cube for use in a portable puzzle where each of the cube's six faces can be cheaply and simply fabricated and assembled.

It is a further object of this invention to provide a set of enclosed body parallelepipedal cubes that is comprised of a single cube exterior face orientation yet still allowing each cube kinematic compatibility in up to three degrees of freedom.

It is yet a further object of this invention to provide a hollow body parallelepipedal cube constituting a minimum use of different components.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
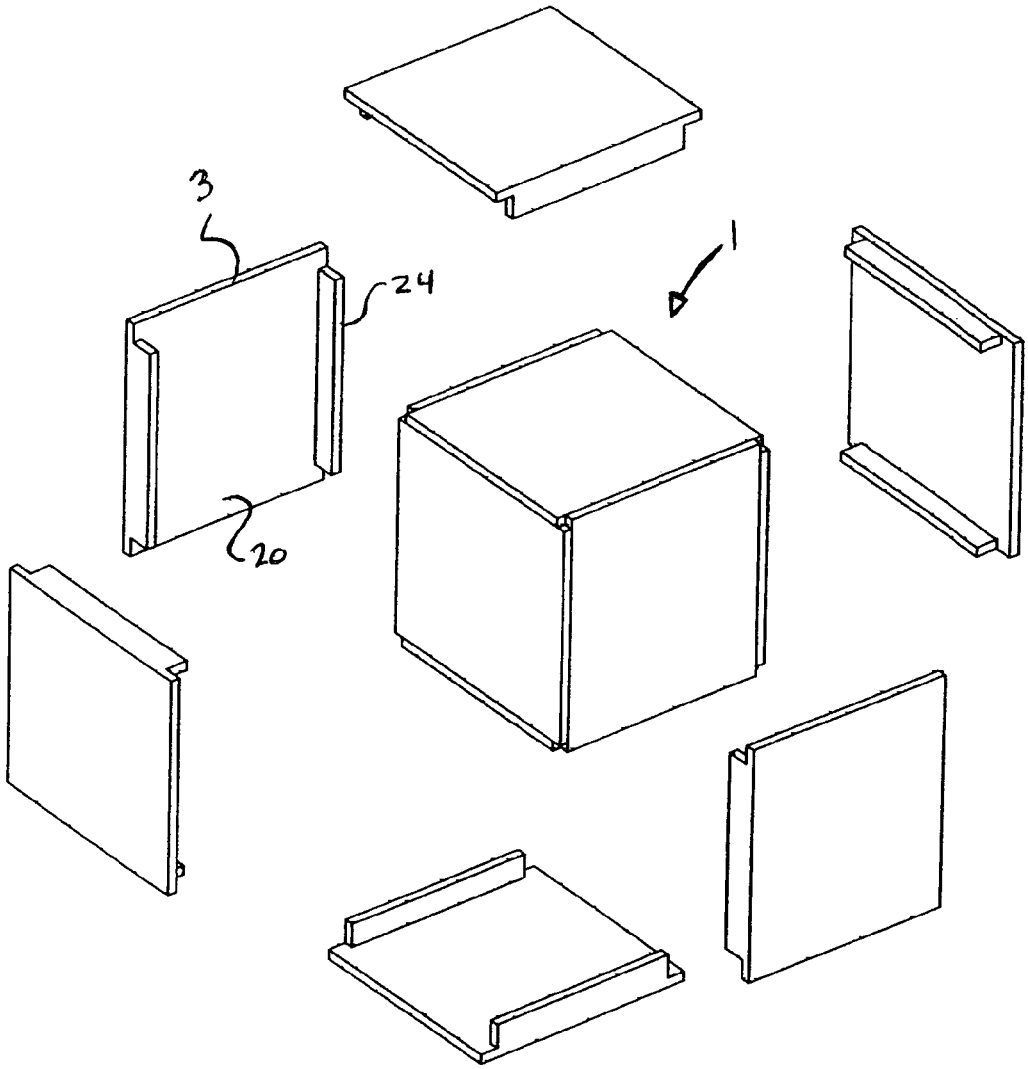
FIG. 1 is an exploded view of the basic assembly concept.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Looking at FIG. 1, an exploded view of the basic assembly concept of a cube can best be seen. (Here the exterior faces 12 have had all T posts 8 and ½ T posts 10 removed for visual clarity.) The physical configuration of the interior faces 20 are identical. Here base cube 1 can be seen as assembled from six substantially similar base face plates 3. The interior faces 20 of the base face plates 3 have two substantially similar linear assembly members 24 extending normally therefrom. Assembly members 24 are parallel and reside on opposite peripheral edges of interior face 20.

Figure 2C:
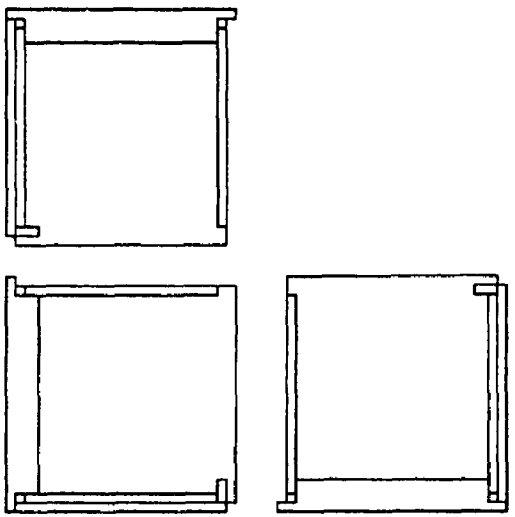
FIG. 2C shows the front, right, and top views of three base face plates joined to make half a cube.
Figure 2B:
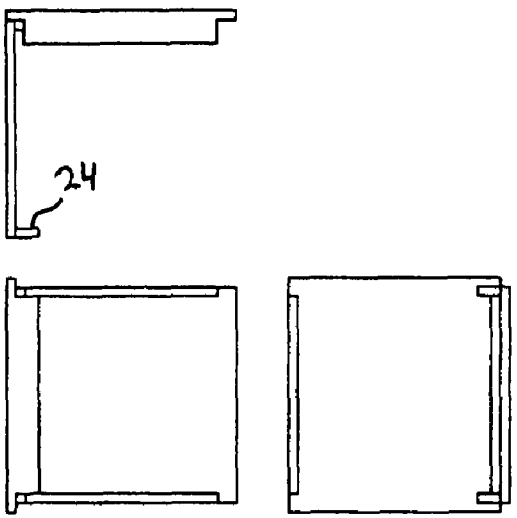
FIG. 2B shows the front, right, and top views of two joined base face plates.
Figure 2A:
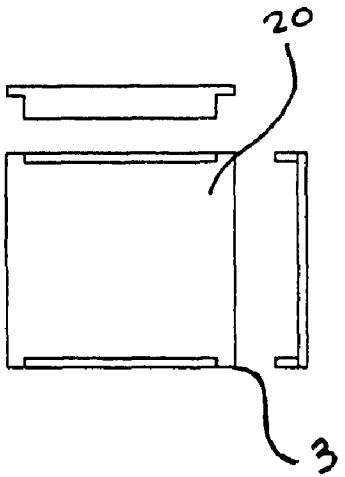
FIG. 2A shows the front, right, and top views of a single base face plates.

Referring to FIGS. 1 and 2 A-C it can be seen that both linear assembly members 24 of one base face plate 3 are designed to contact one linear assembly member 24 of all four adjacent base face plates 3 at 90° (with respect to the linear axes of the members) so as to allow for a surface for adhesion (or other method of affixation) between the adjacent plates. In this manner the linear assembly members 24 of six base face plates 3 can be engaged to form a cube 1 as illustrated. FIG. 2A shows the front, right, and top views of a single base face plate 3. FIG. 2B shows the front, right, and top views of two joined base face plates 3, and FIG. 2C shows the front, right, and top views of three base face plates 3 joined to make half a cube 1.

Figure 3:
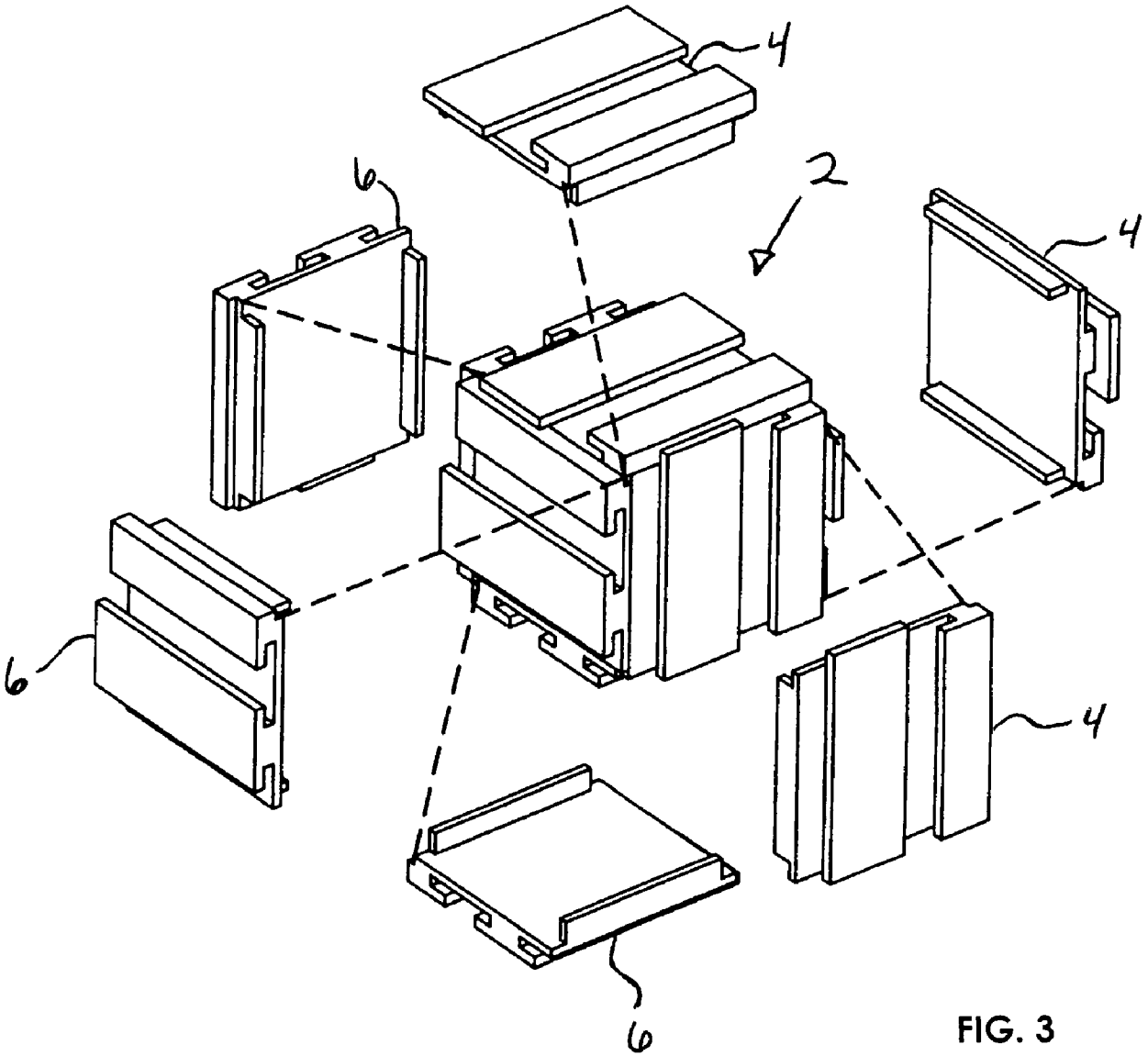
FIG. 3 is an exploded view of the preferred embodiment.

Looking at FIG. 3, an exploded view of the preferred embodiment of the cube 2, it can best be seen that in this design there is a first face plate 4 and second face plate 6, which, when viewing their exterior faces 12, are mirror images. (This is an assembly requirement because of stearic hindrance caused by the overhang of the T posts 8 and ½ T posts 10.) It is to be noted that the arrangement of all first face plates 4 is such that there is a common corner shared by all three of these and at the diagonal corner of the cube resides the common corner for the three second face plates 6.

Figure 4:
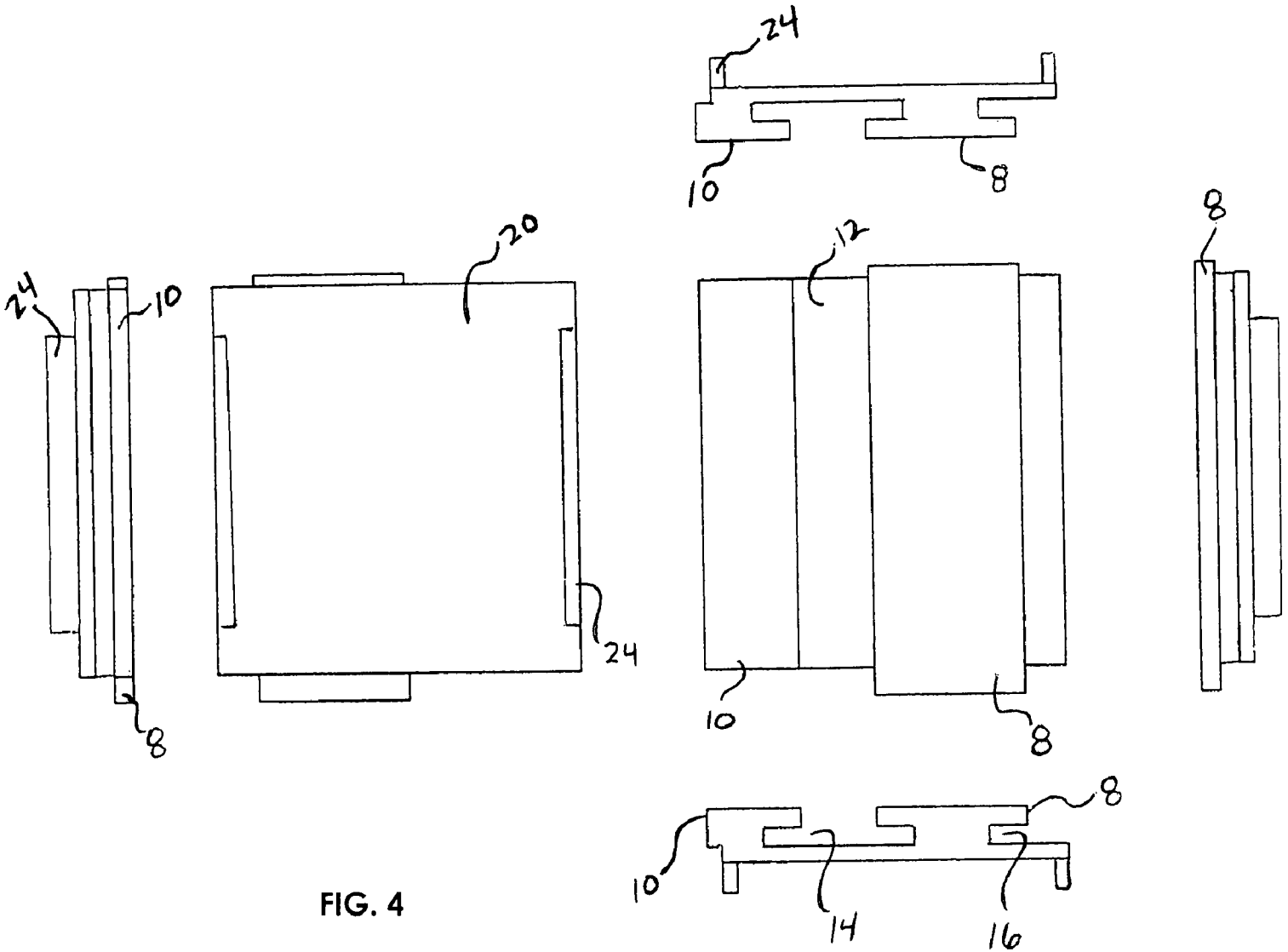
FIG. 4 is set of arranged drawings showing the first plate's exterior face, interior face, end views, and side views.

In FIG. 4, looking at all six views of a face plate (either of 4 or 6) it can be seen that each face plate has one T post 8 and ½ Tee post 10 (formed upon the exterior face 12 thereof so as to form an inverted T slot 14 and an inverted ½ T slot 16 respectively adjacent the ½ T post 10 and T post 8. The inverted T slot 14 is complementary to the T post 8, while the inverted ½ T slot 16 is complementary to the ½ T post 10. This configuration allows for sliding engagement between all face plates when they are oriented correctly. When matingly engaged the off-set design of the face plates allows the plates to slide parallel to the longitudinal axis of the posts or slots. The longitudinal axis of the posts and slots on any exterior face on an assembled cube lies perpendicular to the longitudinal axis of the posts and slots on any and all adjacent faces.

It is known that the Ts and ½ T posts (See FIG. 13) can be tapered to further facilitate the sliding engagement between face plates of neighboring cubes.

It is to be noted that both ends of the T post 8 are cantilevered or extend beyond the edges of face plate 4 or 6. The amount of cantilever of each end is not equal. It is this feature of the design that forces the use of two sets of three each, mirror image plates. If there were no cantilever, the assembly of the cube 2 would require but six substantially similar face plates. It is this cantilever feature that allows for a truer alignment between the faces of adjacent cubes. In this fashion, sliding cubes will always remain guided by the T posts thereby avoiding jamming.

Since the first face plate 4 and the second face plate 6 are mirror images of each other, they have substantially similar length and width dimensions and are rectangular, but are not square. The length of each face plate is defined as the dimension parallel to the longitudinal axis of the slots and Ts thereon and is the largest single physical dimension of the face plates. The width of each face plate is defined as the dimension perpendicular to the longitudinal axis of the Ts and slots thereon. The width of each face plate is shorter than the length of each face plate by two times the thickness of the face plate. This allows for the cube 2 to be a regular hexahedron with each visible face having a square configuration when all face plates are assembled into a monolithic structure as the length dimension of each face plate resides adjacent to the width dimension of each adjacent face plate at all edges of the cube 2.

The alternate embodiments have differing methods of connection and alignment dictated by the different configurations of their interior faces. All cube embodiments have substantially similar exterior faces and are virtually indistinguishable when assembled.

Figure 5C:
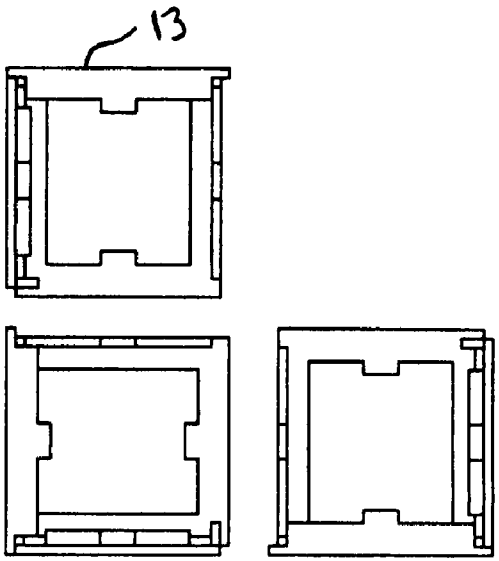
FIG. 5C shows the front, right, and top views of three face plates joined to make half a cube in the first alternate embodiment.
Figure 5B:
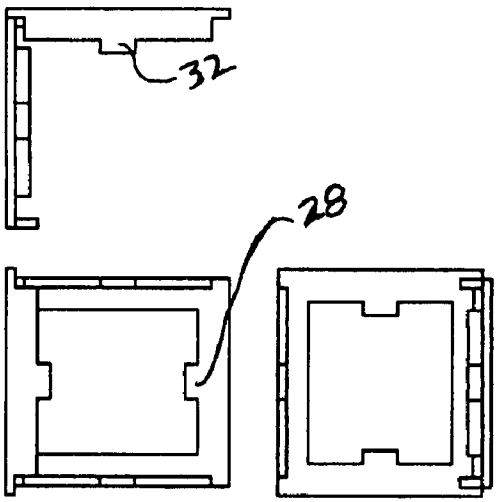
FIG. 5B shows the front, right, and top views of two joined face plates in the first alternate embodiment.
Figure 5A:
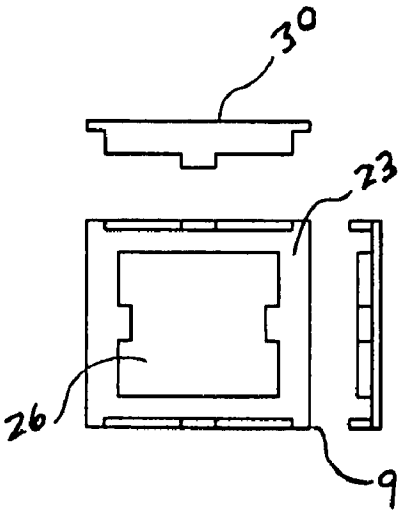
FIG. 5A shows the front, right, and top views of a single face plate in the first alternate embodiment.

The interior face of the face plates of the first alternate embodiment as illustrated in FIG. 5A-5C deviates from the preferred embodiment face plates with two structural differences. On the interior face 23 of first alternate embodiment plates 9 and 11 resides a raised rectangular platform 26 having a smaller surface area than the exterior face 13. In the platform 26 there are two detents 28 formed on opposite sides of the rectangular platform 26 non-adjacent to the modified linear members 30. Each modified linear member 30 has a tab 32 located at the member's midpoint that is matingly conformed to the detent 28. In assembly, the tabs 32 are engaged into the detents 28 in the following manner: from each first plate 9 one tab 32 is inserted into a detent 28 of an adjacent first plate 9 and one tab 32 is inserted into the detent 28 of an adjacent second plate 11; and from each first plate 9 one detent 28 is filed with a tab 32 from an adjacent first plate and one detent is filled with a tab 32 from an adjacent second plate 11. Although discussed as rectangular in shape so as to maximize the gluing surfaces, the platform 26 may be of any shape that supports a detent configuration of a modified linear member 30. As discussed earlier, if the exterior configuration uses T posts that cantilever beyond the edge of the exterior face, then it will be necessary to have a cube assembled wherein half of the plates have mirror image exterior post configuration. If the T post ends even with the plate edge or less than the plate edge then all six of the plates used to assemble the cube will be identical.

Figure 6C:
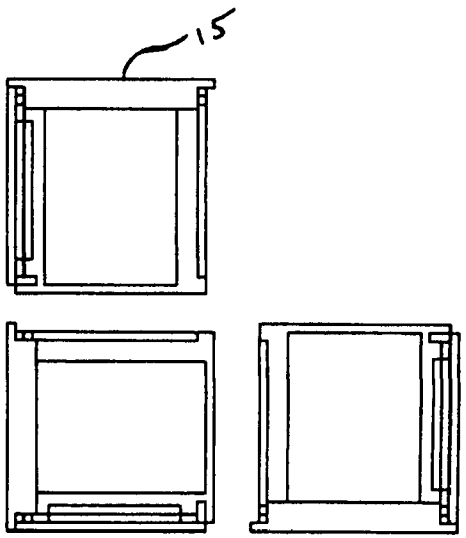
FIG. 6C shows the front, right, and top views of three face plates joined to make a half cube in the second alternate embodiment.
Figure 6B:
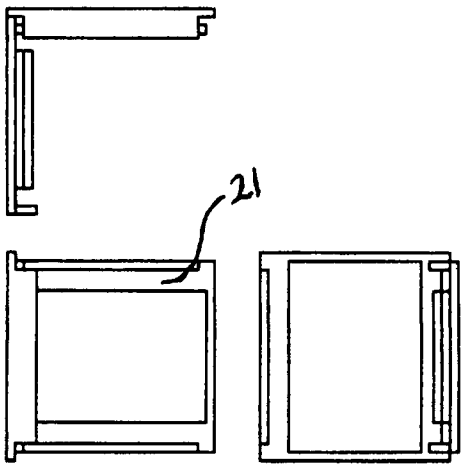
FIG. 6B shows the front, right, and top views of two joined face plates in the second alternate embodiment.
Figure 6A:
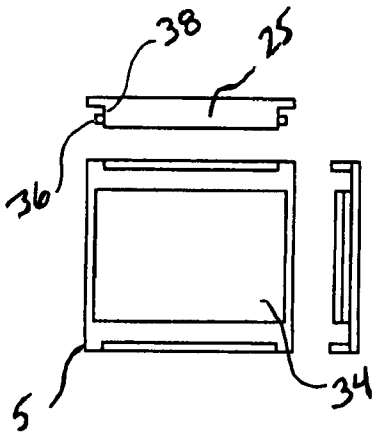
FIG. 6A shows the front, right, and top views of a single face plate in the second alternate embodiment.

The interior face of the face plates of the second alternate embodiment as illustrated in FIG. 6 differs from the preferred embodiment with one structural difference. On the interior face 21 of second alternate embodiment plates 5 resides a raised lip rectangular platform 34 with an exterior lip 36 formed about its perimeter so as to create a groove 38 between the lip 34 and the plate's interior face 21 on two parallel sides. This groove 38 is dimensioned (in depth and width) to accept the linear assembly members 25. The rectangular platform 34 has a smaller surface area than the exterior face 15. There still are two parallel linear members 25 that reside along the edges of the plate (5 or 7) in a similar fashion to that of the preferred embodiment. These linear members 25 reside perpendicular to the grooves 38. In assembly, four of the second alternate embodiment first plates 5 are assembled to form a right cylinder (two of these plates have mirror image exterior face configuration) and one of each of the mirrored image preferred embodiment plates 5 and 7.

Figure 7C:
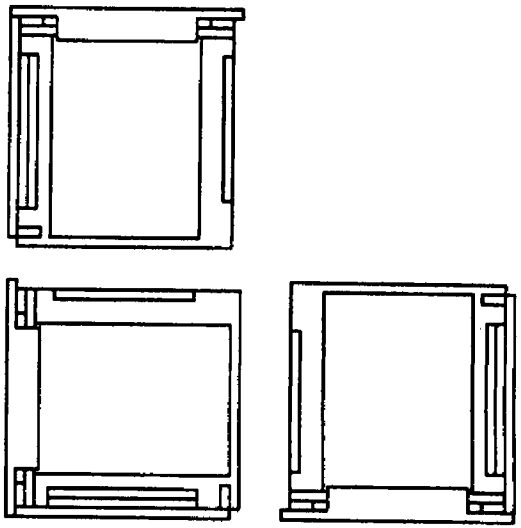
FIG. 7C shows the front, right, and top views of three face plates joined to make a half cube illustration a possible variation of the second alternate embodiment.
Figure 7B:
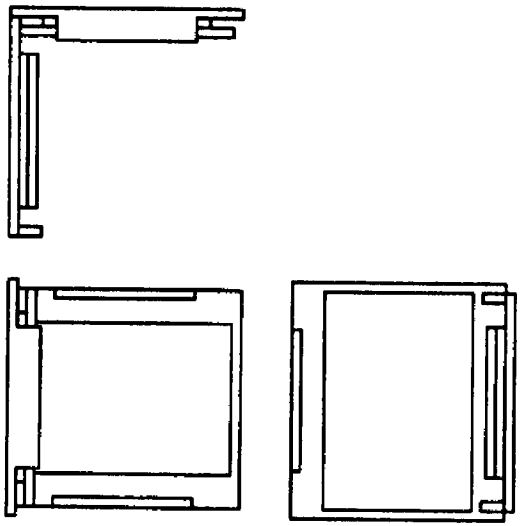
FIG. 7B shows the front, right, and top views of two joined face plates illustrating a possible variation of the second alternate embodiment.
Figure 7A:
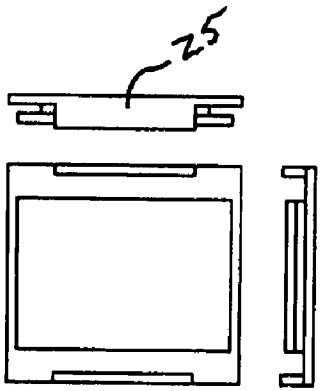
FIG. 7A shows the front, right, and top views of a single face plate illustrating a possible variation of the second alternate embodiment.

It is to be noted that the length of linear assembly members 25 may be varied in this second alternate embodiment for ease of assembly or material costs as illustrated in FIGS. 7A-7C.

Figure 11:
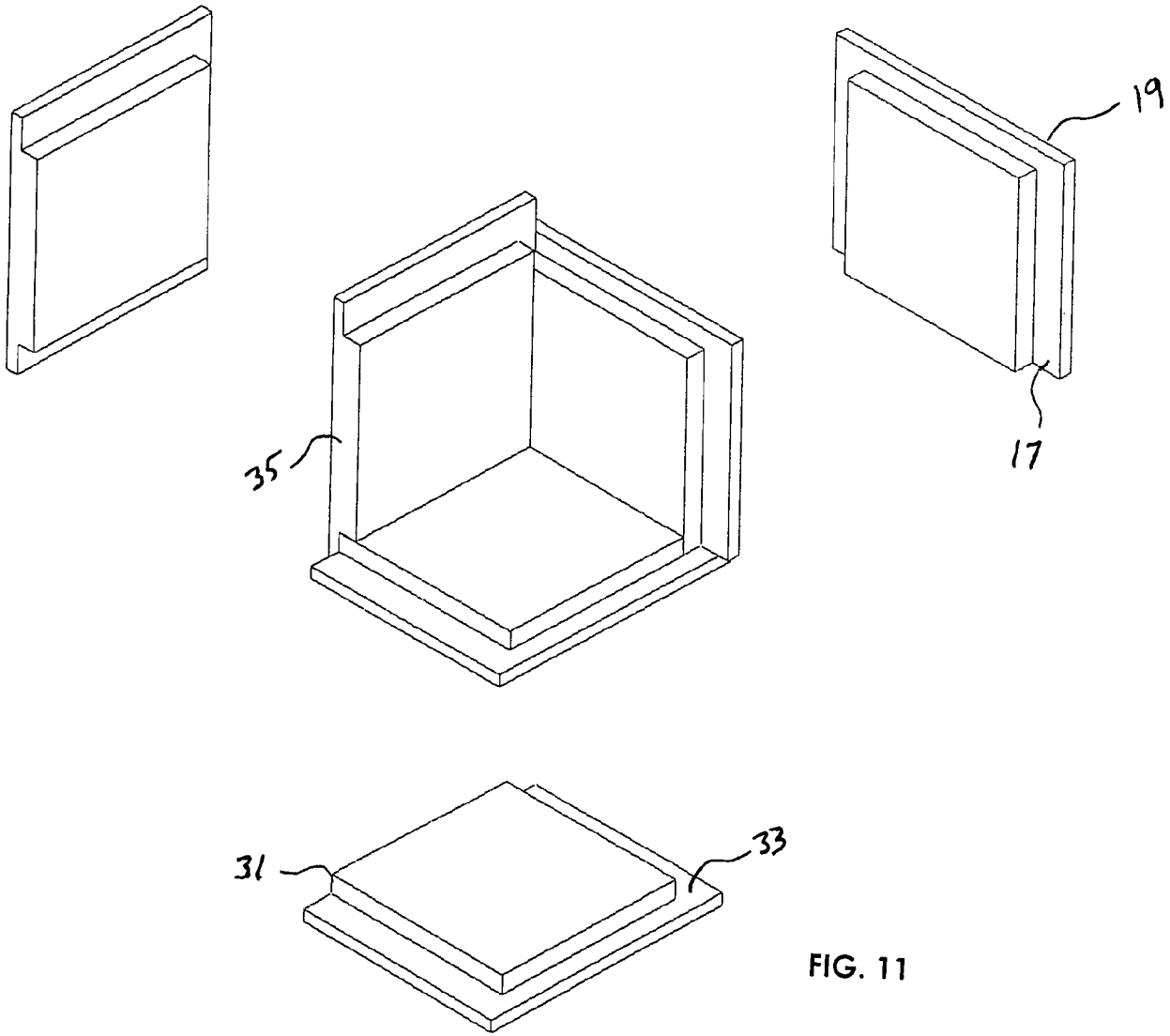
FIG. 11 is an exploded view illustrating the partial assembly of a third alternate embodiment.

The interior face of the face plates of the third alternate embodiment as illustrated in FIG. 11 employs an offset raised platform 31. On the interior face 33, of third alternate embodiment plates 17. The offset raised platform 31 has a smaller surface area than the exterior face 19. The offset raised platform 31 and third alternate embodiment plate 17 share a common edge 35 such that there is symmetry about their width axis. Assembly of a complete cube requires six plates 17.

Figure 13:
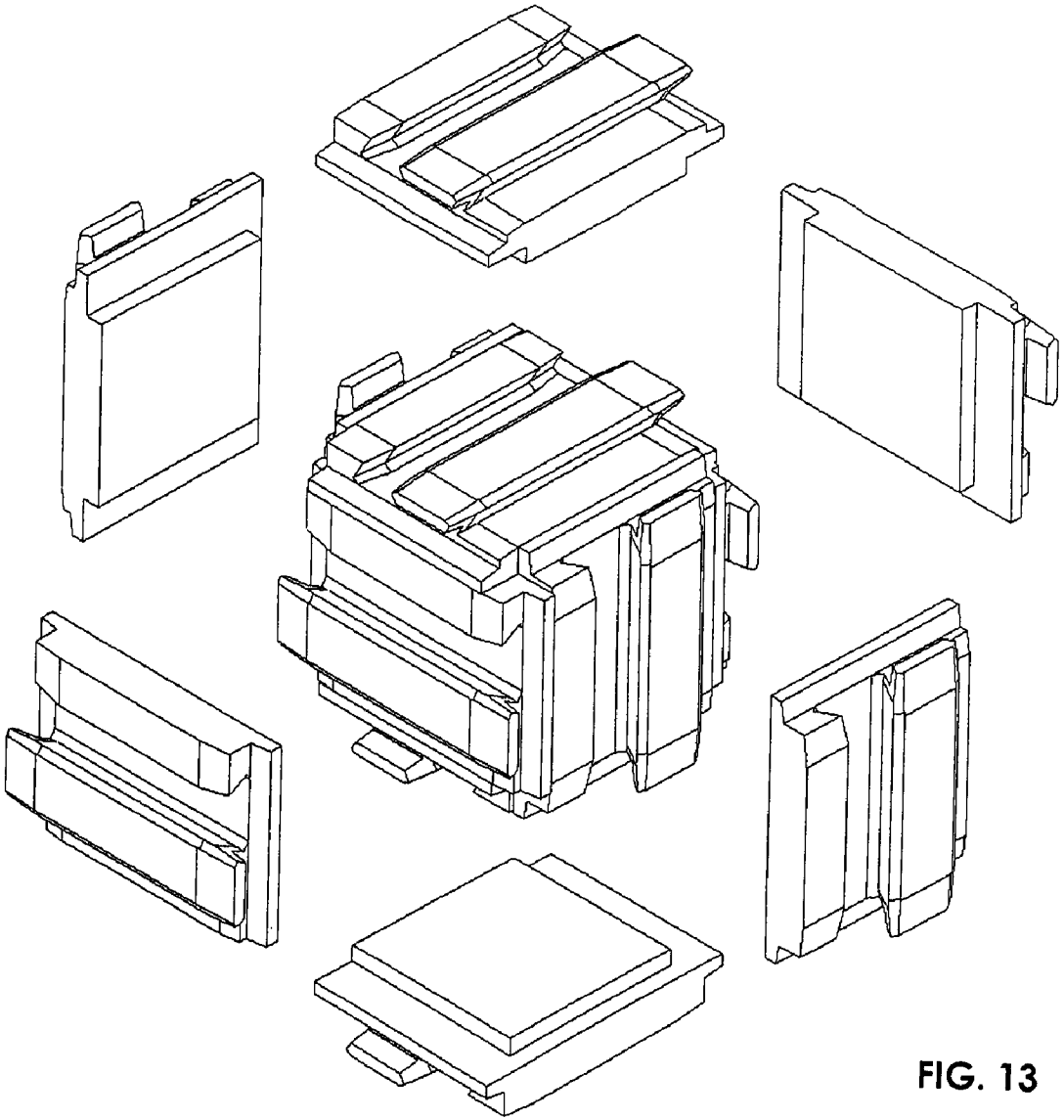
FIG. 13 is an exploded view incorporating the fourth alternate embodiment on the interior faces and the T post and ½ T posts on the exterior faces.

FIG. 13 illustrates the offset raised platform interior design of the third alternate embodiment with T posts and ½ T posts on the exterior faces.

Figure 12:
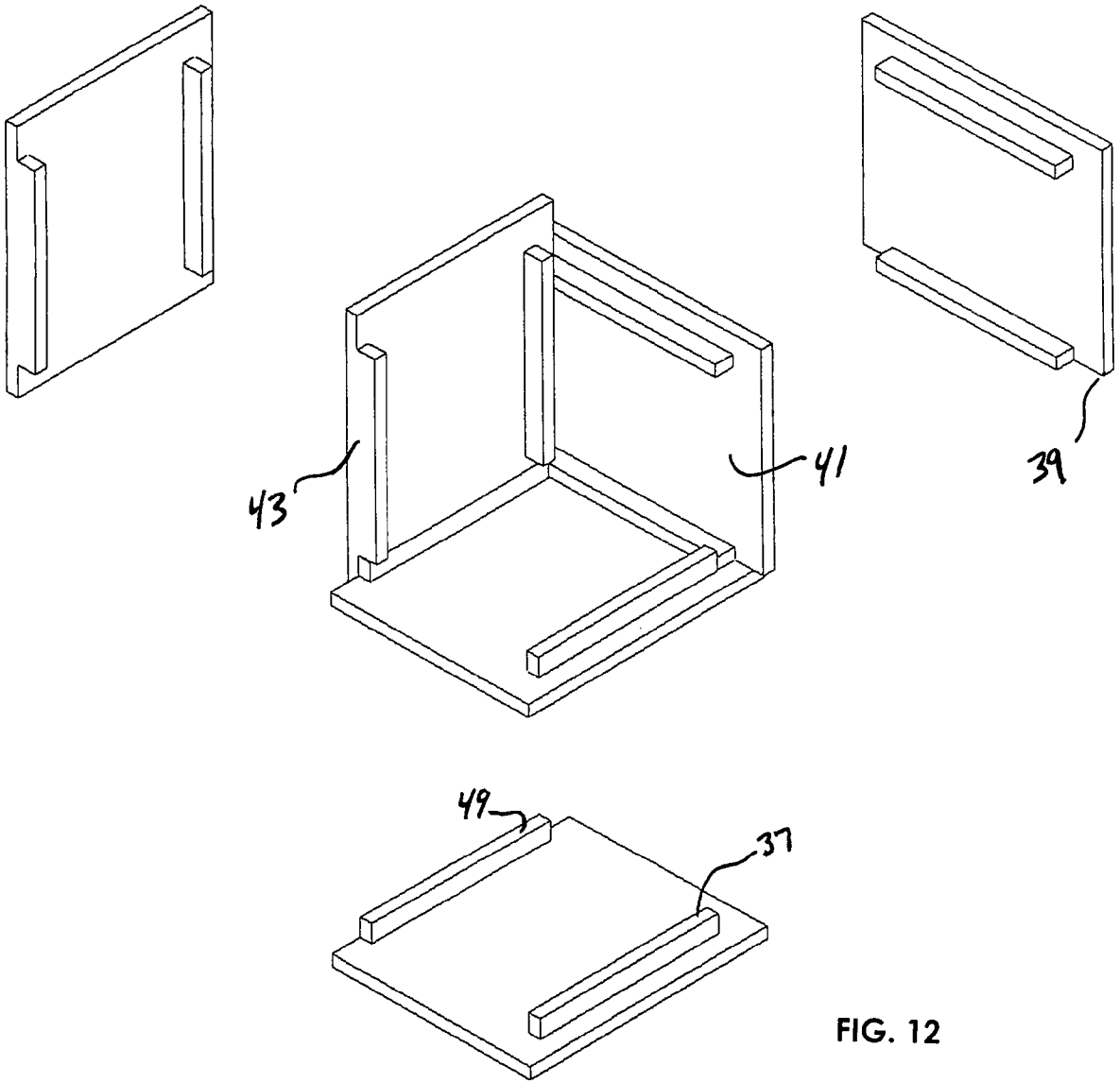
FIG. 12 is an exploded view illustrating the partial assembly of a fourth alternate embodiment.

The interior face of the face plates of the fourth alternate embodiment is illustrated in FIG. 12. The fourth alternate embodiment employs the same offset design of the third alternate embodiment but instead uses offset parallel linear members 37 instead of an offset raised platform 31. On the interior face 41 of the fourth alternate embodiment plates 39 reside a first offset linear member 37 extending normally from interior face 41 and a second offset linear member 49 also extending normally from interior face 41. Said first offset linear member shares a common edge 43 with fourth alternate embodiment plate 39 such that there is symmetry about their width axis. Assembly requires six plates 39.

The following table explains the plate types and their assembly.

| Cube Type | Plate A Interior Face | Plate B Interior Face | Plate C | Assembly |
|---|---|---|---|---|
| PE #1 | | | | |
| conventional T and ½ T posts with or without click stops | two parallel linear members on opposing edges of rectangular plate | N/A | N/A | 6 of PE#1 Plate A |
| cantilevered T post | two parallel linear members on opposing edges of rectangular plate | N/A | No Change but Exterior face is the Mirror image of PE plate A | 3 of PE#1 plate A & 3 of PE#1 plate C |
| AE #1 | | | | |
| conventional T and ½ T posts with or without click stops | raised platform with two detents on two parallel platform edges & two parallel linear members with mating tabs on two face edges | N/A | N/A | 6 of AE#1 plate A |
| cantilevered T post | raised platform with two detents on two parallel platform edges & two parallel linear members with mating tabs on two face edges | N/A | No Change but Exterior face is the Mirror image of AE#1 plate A | 3 of AE#1 plate A & 3 of AE#1 plate C |
| AE # 2 | | | | |
| conventional T and ½ T posts with or without click stops | raised platform with upper lip and groove thereon all four sides and two parallel linear members on two face edges | two parallel linear members on opposing edges of rectangular plate & no platform | N/A | 4 of PE#2 plate A & 2 of PE#2 plate B |
| cantilevered T post | raised platform with upper lip and groove thereon all four sides | two parallel linear members on opposing edges of rectangular | Exterior Mirror image of Plate 1 and Plate 2 | 4 of PE#2 plate A & 2 of PE#2 plate B & 1 of each |

-continued

| Cube Type | Plate A Interior Face | Plate B Interior Face | Plate C | Assembly |
|---|---|---|---|---|
| | and two parallel linear members on two face edges | plate & no platform | | AE#2 mirror image plates |
| AE #3 | | | | |
| conventional T and ½ T posts with or without click stops | raised offset platform | N/A | N/A | 6 of AE#3 Plate A |
| cantilevered T post | raised offset platform | N/A | No Change but Exterior face is the Mirror image of AE#3 plate A | 3 of AE#3 plate A & 3 of AE#3 plate C |
| AE #4 | | | | |
| conventional T and ½ T posts with or without click stops | two offset parallel linear members | N/A | N/A | 6 of AE#4 Plate A |
| cantilevered T post | two offset parallel linear members | N/A | No Change but Exterior face is the Mirror image of AE#4 plate A | 3 of AE#4 plate A & 3 of AE#4 plate C |

With the aforementioned design and embodiments, it is possible to fabricate the face plates as monolithic components with such methods as injection molding. This greatly reduces the cost of fabrication as compared to prior art designs.

Figure 8:
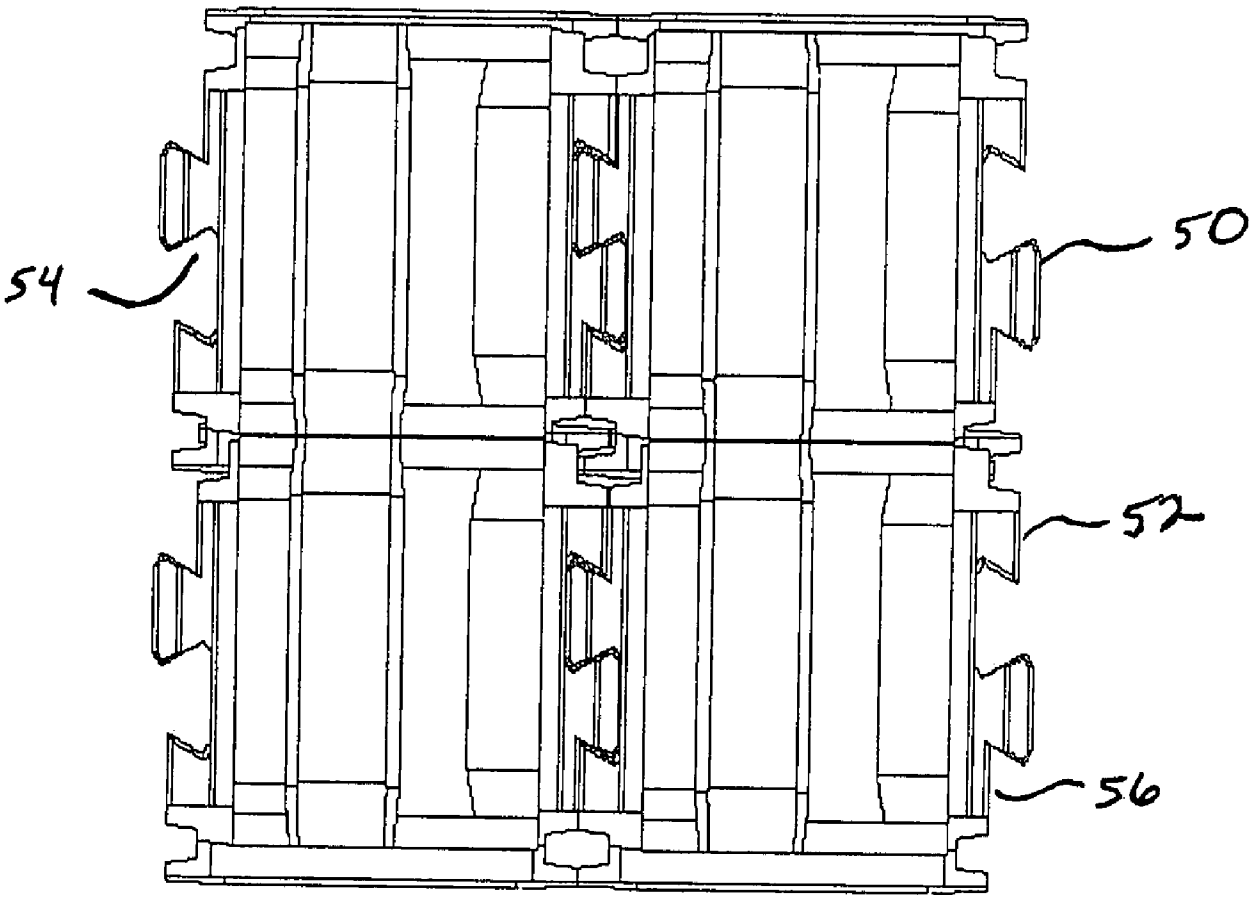
FIG. 8 shows a dovetail configuration of the T post and ½ T posts on four matingly engaged cubes.

It is also known that a matingly engageable dovetail formation of a dovetail T post 50, dovetail ½ T post 52, dovetail T slot 54 and dovetail ½ T slot 56 may be utilized as an optional embodiment to any of the plates illustrated and described herein (See FIG. 8).

Looking at FIG. 8 the effect of having a T post that is cantilevered can be seen, as adjacent plate's T posts create a unitary linear member therein reducing jamming was the cubes are slidingly engaged along that longitudinal direction. This provides and overlapping joint when two, three, or four cubes meet at their common edge. This overlap means that the cubes are already aligned with each other before they begin to move.

Figure 14:
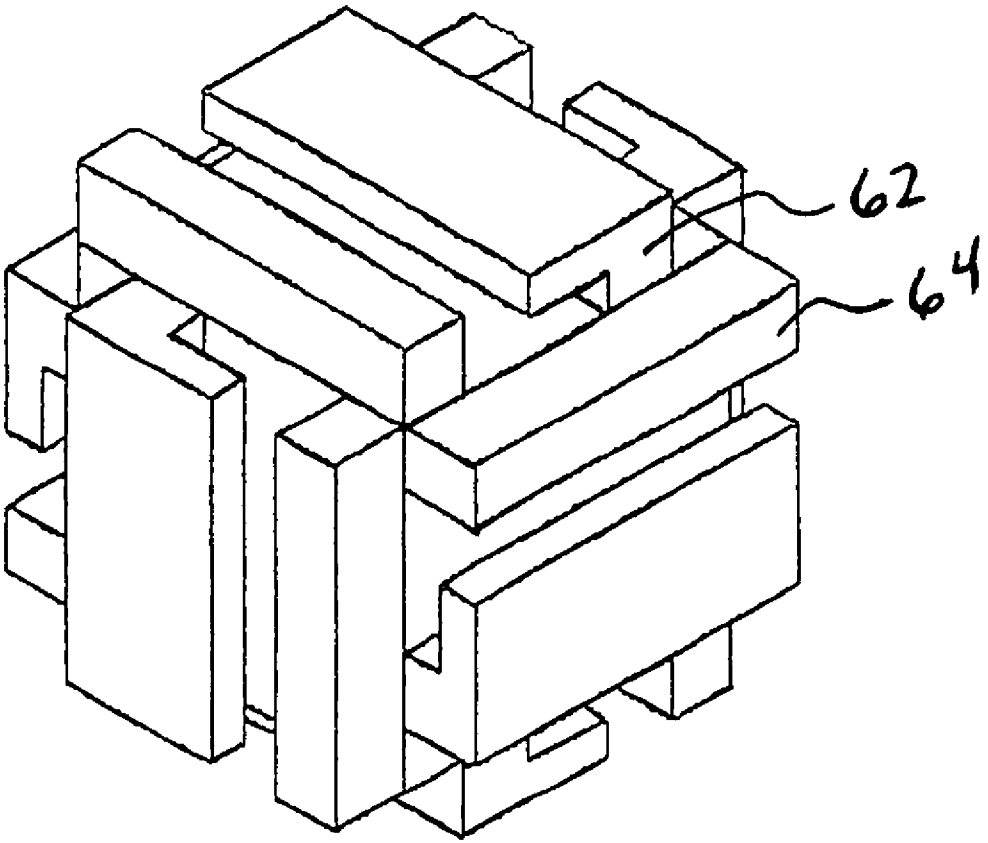
FIG. 14 illustrates an assembled cube with L posts and linear posts on the exterior faces.

Looking at FIG. 14, it can be seen that a matingly engageable L post 62 formation with linear post 64 is another optional embodiment to any of the plates illustrated and described herein.

Figure 9:
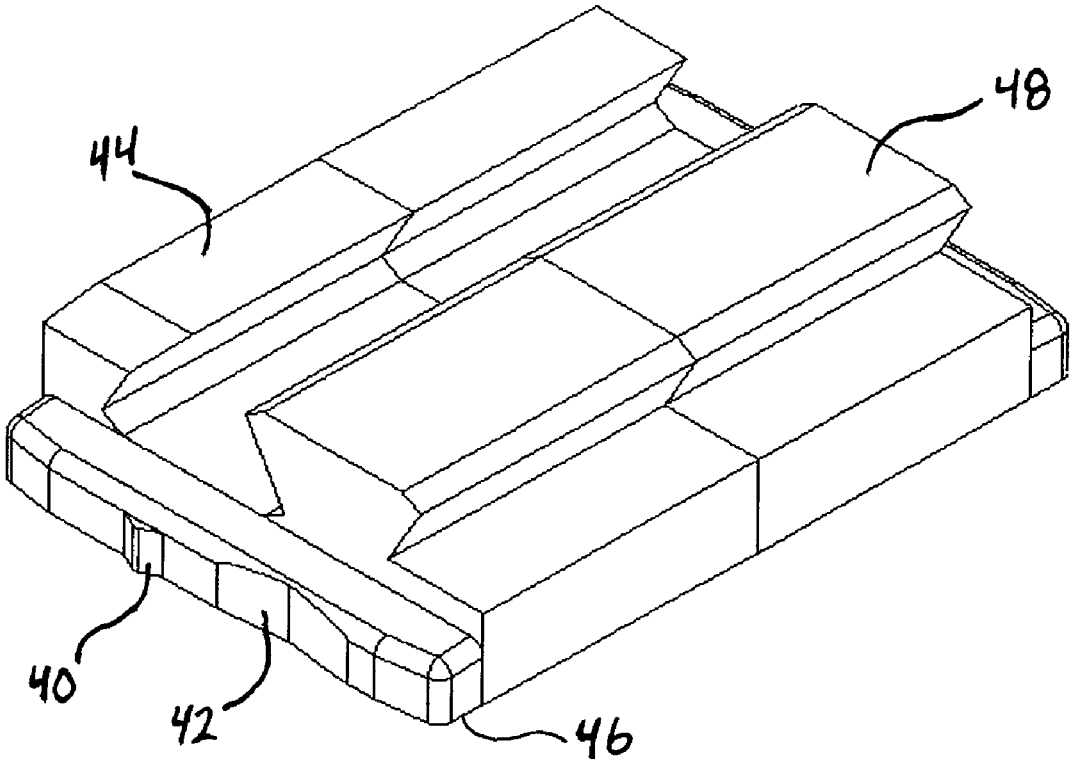
FIG. 9 shows a perspective view of a base plate with dovetail configuration of the T post and ½ T posts and a click-stop area.

FIG. 9 illustrates another optional embodiment click stop exterior face plate configuration that can be utilized with any of the interior face plate configurations discussed herein. This click stop design has the same effect of alignment of the cube that is accomplished utilizing a cantilevered T post. The click stop face plate 44 employs at least one (preferably two) sets of complimentary alignment buttons 40 and recesses 42 on the two edges 46 of the click stop face plate 44 that reside perpendicular to the longitudinal axis of the dovetail T post 48. When the adjacent cubes are closely aligned, the recesses 42 will tightly draw the buttons 40 into a precise location that finely tunes or aligns the cubes edges and longitudinal axes of T posts, therein eliminating the need for cantilevered T posts. In this embodiment the click-stop would serve as the primary bearing surface for movement.

Figure 10:
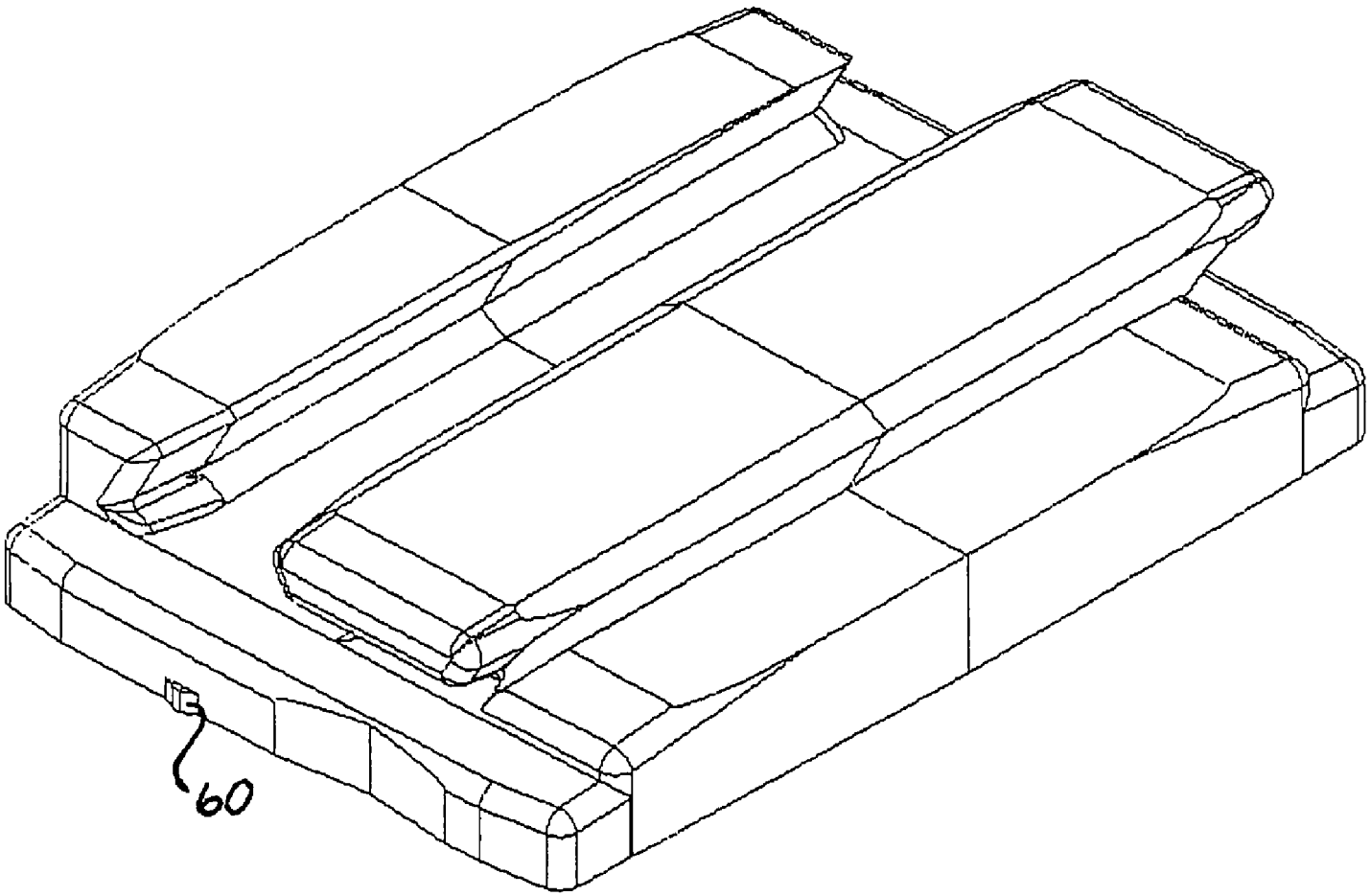
FIG. 10 shows a perspective view of a base plate with the T post and ½ T posts and an offset button in the click-stop area.

As another embodiment of the click stop, FIG. 10 illustrates an offset button 60. This facilitates the sliding of cubes without interference between buttons. In the previous embodiment, the cubes must separate slightly as the buttons pass over each other.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

The invention claimed is:

1. A regular hexahedron comprised of:

six rectangular plates each having a rectangular top surface and a rectangular bottom surface and having a dimension of length and a dimension of width, wherein said dimension of length exceeds said dimension of width and wherein there is a plate width axis and a plate length axis, and wherein said bottom surface has two length edges, two width edges and an offset raised rectangular platform formed thereon, wherein said platform has a smaller surface area than a rectangular plate's surface area and has a center that is offset from a center of said rectangular plate; and wherein said platform and said bottom surface share a common edge such that there is symmetry about the plate width axis; and wherein said length axis of each said rectangular plate resides perpendicular to said length axis of all rectangular plates with which it shares a single, common edge.

2. The regular hexahedron of claim 1 wherein said all rectangular plates have a substantially similar top surface having a "Tee" (T) shaped post traversing the length of said top surface and residing parallel to, but offset from, a longitudinal axis residing in the length dimension of said top surface, and a ½ "Tee" (½ T) shaped post residing parallel to said "Tee" (T) shaped post and adjacent to a top length edge such that a complementary inverted "Tee" (T) shaped slot is formed therebetween said posts and a complementary inverted ½ "Tee" (½ T) shaped opening is formed adjacent to said "Tee"(T) shaped post.

3. The regular hexahedron of claim 2 wherein said plates have a first top length edge and a parallel second top length edge and two width edges wherein said width edges are dimensionally shorter than said length edges.

4. The regular hexahedron of claim 2 wherein said T shaped posts extend beyond the width edges of said top surface in a cantilevered fashion and wherein a first three of said plates have said ½ "Tee" (½ T) shaped post residing adjacent to a first top length edge and a second three of said plates have said ½ "Tee" (½ T) shaped post residing adjacent to a second top length edge such that said first three plates and said second three plates have mirror image exterior post configurations.

5. The regular hexahedron of claim 4 wherein the arrangement of all said plates is such that there is a first common corner shared by all said first three plates and at a diagonal corner of the cube resides a second common corner shared by all second three plates.

6. The regular hexahedron of claim 5 wherein said T posts and ½ T posts are configured as sliding dovetails.

* * * * *